US011590520B2

(12) United States Patent
Seeberger

(10) Patent No.: US 11,590,520 B2
(45) Date of Patent: Feb. 28, 2023

(54) DISPENSING DEVICE FOR SPRAYING A SPRAYABLE MEDIUM

(71) Applicant: Gelupas GMBH, Schönaich (DE)

(72) Inventor: Gerhard Seeberger, Schönaich (DE)

(73) Assignee: Gelupas GmbH, Schönaich (DE)

( * ) Notice: Subject to any disclaimer, the term of this patent is extended or adjusted under 35 U.S.C. 154(b) by 384 days.

(21) Appl. No.: 16/640,322

(22) PCT Filed: Aug. 7, 2018

(86) PCT No.: PCT/EP2018/071436
§ 371 (c)(1),
(2) Date: Feb. 19, 2020

(87) PCT Pub. No.: WO2019/038081
PCT Pub. Date: Feb. 28, 2019

(65) Prior Publication Data

US 2021/0078023 A1 Mar. 18, 2021

(30) Foreign Application Priority Data

Aug. 25, 2017 (DE) ..... 10 2017 119 462.2

(51) Int. Cl.
*B05B 7/24* (2006.01)
*B05B 15/50* (2018.01)
(Continued)

(52) U.S. Cl.
CPC ..... *B05B 7/2416* (2013.01); *B05B 15/50* (2018.02); *A45D 19/02* (2013.01); *A45D 2200/057* (2013.01); *B05B 7/1472* (2013.01)

(58) Field of Classification Search
CPC ... B05B 7/1472; B05B 7/2416; B05B 7/0815; B05B 7/2429; B05B 7/0869; B05B 15/50; A45D 19/02; A45D 2200/057
See application file for complete search history.

(56) References Cited

U.S. PATENT DOCUMENTS 4,681,262 A * 7/1987 Sprute ..... B65D 83/60 239/306
5,102,052 A * 4/1992 Demarest ..... B05B 11/06 239/525

(Continued)

FOREIGN PATENT DOCUMENTS

EP 1023911 A2 * 8/2000 ..... A61M 11/002
EP 2599507 A1 6/2013
WO WO-2017129750 A1 8/2017

OTHER PUBLICATIONS

International Preliminary Report on Patentability issued in corresponding application PCT/EP2018/071436, dated Feb. 25, 2020.

(Continued)

*Primary Examiner* — Justin M Jonaitis
(74) *Attorney, Agent, or Firm* — Renner, Otto, Boisselle & Sklar, LLP

(57) ABSTRACT

The invention relates to a dispensing device (11) for spraying a sprayable medium, in particular a fluid or powder, which device is designed as a handheld apparatus, in which a compressed air device (86) is provided, comprising a spray head (14) that is connected to the housing (12) and is intended for dispensing the medium, comprising a fluid line (44) leading from the storage container (41) to the spray head (14) and comprising a supply line (36) leading from the compressed air device (86) to the spray head (14), and comprising a first nozzle (38) that is connected to the supply line (36) and, separately therefrom, comprising a second nozzle (46) that is connected to the fluid line (44) and that protrudes into an airflow emerging from the first nozzle (38), such that an atomizing zone (49) is formed outside of the spray head (14), wherein, in a plan view of the outlet opening (83) of the first nozzle (38), the second nozzle (46) covers at least 1% of an internal cross section of the first nozzle (38).

14 Claims, 10 Drawing Sheets

Figure 1:
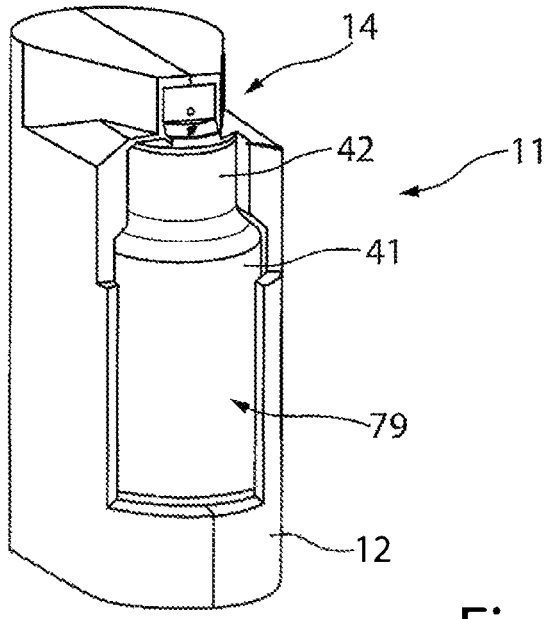

(51) Int. Cl.
*A45D 19/02* (2006.01)
*B05B 7/14* (2006.01)

(56) References Cited

U.S. PATENT DOCUMENTS

| | | | | |
|---|---|---|---|---|
| 9,511,166 | B1 * | 12/2016 | Li | B05B 7/2416 |
| 2003/0108487 | A1 * | 6/2003 | Bara | A45D 34/04 424/47 |
| 2004/0050963 | A1 | 3/2004 | Ray et al. | |
| 2006/0054644 | A1 * | 3/2006 | Chen | B05B 7/2429 222/401 |
| 2006/0219814 | A1 * | 10/2006 | Benalikhoudja | B05B 7/0869 239/340 |
| 2007/0138316 | A1 * | 6/2007 | Iyengar | A62C 13/64 239/398 |
| 2015/0174595 | A1 * | 6/2015 | Young | A61L 9/14 261/78.2 |
| 2016/0192760 | A1 | 7/2016 | Nishiura et al. | |

OTHER PUBLICATIONS

International Search Report (English translation) issued in PCT/EP2018/071436, dated Nov. 13, 2018; ISA/EP.

* cited by examiner

DISPENSING DEVICE FOR SPRAYING A SPRAYABLE MEDIUM

CROSS-REFERENCE TO RELATED APPLICATIONS

This application is a 371 National Phase of International Application No. PCT/EP2018/071436, filed on Aug. 7, 2018, which claims priority to German Application No. 10 2017 119 462.2, filed on Aug. 25, 2017. The entire disclosures of the above applications are incorporated herein by reference.

The invention relates to a dispensing device for spraying a sprayable medium, which device is designed as a handheld apparatus.

For applying make-up, what is referred to as an airbrush system is known. Devices of this kind are used by professional make-up artists. Said devices comprise a compressor and a plurality of hose lines, which remove the relevant make-up from individual reservoirs of different make-ups and apply it via a common spray nozzle. Said devices are cleaned following used, so as to be provided again for the next use. However, airbrush systems of this kind are not suitable for carrying in a handbag, which would allow, for example, for quick application or touching up of the make-up.

A dispensing device in the form of a hand apparatus for spraying a sprayable fluid is known from US 2004/0050963 A1. Said hand apparatus comprises a motor for generating compressed air, which is guided to a spray head by means of a compressed air line. Furthermore, an insert comprising a medium to be dispensed is provided in the housing, wherein a nozzle of the insert is also associated with the spray head. An outwardly facing opening is provided in the housing, which opening is associated with an atomizing zone arranged inside the housing. The compressed air is supplied to the atomizing zone. The nozzle for supplying the dispensed medium opens into the atomizing zone. When the compressed air and the medium to be dispensed meet, said medium is swirled and mixed within the atomizing zone, in the housing, before emerging out of the housing through the opening.

A dispensing device that comprises a motor in a housing and an air pump that is driven by the motor is known from U.S. Pat. Nos. 5,046,667 A and 5,192,009 A, in the form of a handheld apparatus. Furthermore, a storage container for a fluid to be applied is provided in the handheld apparatus. In said dispensing device, the fluid to be dispensed is mixed with the air in a mixing chamber of the spray head, and subsequently dispensed via a nozzle. In handheld apparatus of this kind, drying of the fluid to be dispensed can lead to the nozzle becoming clogged, with the result that the entire dispensing device becomes inoperable. Furthermore, application of the medium to be dispensed, in particular make-up, is often non-uniform, making handling more difficult.

The object of the invention is that of providing a dispensing device for spraying a sprayable medium in particular fluid or powder, which device, in addition to being designed as a handheld apparatus, allows for fine spraying and uniform application of the medium to a surface.

This object is achieved by a dispensing device for spraying a sprayable medium, in particular fluid or powder, which device is designed as a handheld apparatus and in which the first and/or the second nozzle is/are designed as a hole in the spray head or as a tube portion that is inserted into the spray head. This allows for a varied design of the spray head and the mutual arrangement and association of the first and second nozzle in the atomizing zone. Depending on the media to be dispensed, it is possible to select whether a hole is made in the spray head or whether an additional length of pipe is provided. In particular, in the case of sensitive media, an additional length of pipe may be advantageous, provided that the spray head consists for example of plastics material. In a very cost-effective embodiment, the spray head can consist of plastics material, and the two holes, which form the first and second nozzle, can be arranged integrally in the spray head.

According to a preferred embodiment, in a plan view of a dispensing opening of the first nozzle, the second nozzle covers at least 1% of an internal cross section of the first nozzle. Such an orientation of the two nozzles relative to one another can form an atomizing zone for the fluid or powder to be applied, which zone allows for fine atomization of the fluid or powder to be sprayed. In this case, the orientation of the two nozzles relative to one another achieves a flow around the second nozzle, which generates a Bernoulli effect at the outlet opening of the second nozzle. Said Bernoulli effect is increased in that the flow speed of the airflow emerging from the first nozzle increases due to the nozzle effect. The Bernoulli effect causes the fluid or powder to be conveyed out of the second nozzle and supplied to the atomizing zone. As a result, it is possible to generate a very fine spray mist, even in the case of fluids of different viscosities or powders having different degrees of grinding, which mist allows for uniform application on a surface, for example on the skin of a user. Drop formation can be prevented. Furthermore, full-surface application can be made possible. Thus, in the case of a short spacing between the dispensing device and the point of application, it is also possible to allow for only targeted punctiform application of the fluid or powder. Since the nozzles are preferably located outside a spray head and form an atomizing zone outside of the two nozzles, it is furthermore possible to prevent drying out or sticking of the nozzles in the spray head. As a result, the handheld apparatus is usable for a longer period of time.

The atomizing zone is preferably provided outside of the spray head, wherein the first nozzle is provided in a first end face of the spray head and the second nozzle is provided in a second end face of the spray head, and the first and second end faces adjoin one another or transition into one another. In this case, it may be possible for the first and second end face to adjoin one another at right angles. It may also be possible for the second end face to be oriented so as to be inclined with respect to the first end face, and to occupy an angle of greater than 90°. It is furthermore possible that for example the two end faces proceeding from the first end face have a curved or trough-like course, wherein the end face can be oriented towards a leading edge of the second nozzle.

The front face of the first nozzle is preferably in the first end face of the or protrudes relative thereto, and/or the front face of the second nozzle is in the second end face or protrudes relative to the second end face of the spray head. In this embodiment, the airflow emerging from the first nozzle or a wall nozzle can flow around the second nozzle, such that the airflow forcibly sucks the medium, in particular the fluid or powder, out of the second nozzle by means of a vacuum effect. The medium is first atomized by means of the stall edge on the end face of the second nozzle, and is subsequently sprayed.

It is advantageously possible for a leading edge and a trailing edge, opposite the leading edge, to be provided on a front face of the second nozzle, wherein the leading edge is associated with the first nozzle and the front face of the second nozzle is arranged at an angle of incident flow p of more than 0° relative to a central axis of the first nozzle, such that the outlet opening of the second nozzle is oriented so as to face away from the outlet opening of the first nozzle. This design of the nozzle arrangement makes it possible to achieve flow conditions at the outlet opening of the second nozzle that allow for optimal dispensing of the fluid or powder and result in a very homogeneous spray mist. As a result, it is possible to achieve a very uniform application of material on the surface.

It may preferably be possible for the leading edge of the second nozzle of the outlet opening to be associated with the first nozzle in a tangential manner. As a result, it is possible for the leading edge of the second nozzle to be arranged at a small spacing from the outlet opening of the first nozzle. In this case, it may be possible for the leading edge to contact the front face of the first nozzle in a tangential manner. Such a close arrangement of the outlet opening of the second nozzle relative to the outlet opening of the first nozzle makes it possible to for flow conditions having different flow speeds to be formed at the second nozzle. These different flow speeds can promote the Bernoulli effect, such that, in addition to very fine atomization of the fluid or powder, optimal dispensing of the fluid or powder to be applied, out of the second nozzle, is achieved.

According to a further advantageous embodiment of the dispensing device, the front face of the first nozzle is oriented so as to be at an angle of inclination γ of less than 90° relative to the central axis of the first nozzle, and for a stall edge that is set back and one that protrudes, relative to the central axis, in the dispensing direction, to be formed, wherein the protruding stall edge of the leading edge is associated with the second nozzle. The stall edge that protrudes relative to the central axis, in the dispensing direction, makes it possible to achieve an extended flow channel for guiding the airflow, such that the airflow strikes the leading edge of the second nozzle at an optimal flow angle.

Particularly preferably, it may be possible for the front face of the first nozzle to comprise a cannula-like bevel and for a stall edge that protrudes relative to the outlet opening in the dispensing direction to be formed, which stall edge is associated with the second nozzle. This design of the first nozzle also makes it possible to achieve a guide for the airflow, in which the airflow is supplied to an end portion of the second nozzle at an angle of incident flow that promotes the airflow.

In a further preferred embodiment, it may be possible for the front face of the first nozzle to comprise a V-shaped or U-shaped notch. This design of the first nozzle, too, makes it possible to achieve an optimized airflow at the second nozzle, which has a positive influence both on the material dispensing from the second nozzle and on the atomization of the fluid or powder.

In a further embodiment of the dispensing device, it may be possible for the front face of the second nozzle to be oriented so as to be inclined relative to a plane extending horizontally through the central axis of the first nozzle, in a plan view of the outlet opening of the first nozzle. This inclined arrangement of the front face of the second nozzle makes it possible to influence the amount of the fluid or powder to be dispensed, such that the angle of inclination of the front face of the second nozzle allows for adjustment to the viscosity of the fluid or the degree of grinding of the powder.

According to a development of the dispensing device, a side edge of the front face of the second nozzle, seen in a plan view of the outlet opening of the first nozzle, is arranged above the plane that extends horizontally through the central axis of the first nozzle, and a side edge of the front face that is opposite said side edge is arranged below said plane. This design of the dispensing device also make it possible to meter the amount of the fluid or powder to be applied.

According to an alternative development of the dispensing device described above, the side edge of the front face of the second nozzle, seen in a plan view of the outlet opening of the first nozzle, is arranged above the plane that extends horizontally through the central axis of the first nozzle. This design also makes it possible to influence metering of the amount of the fluid or powder to be dispensed.

It may advantageously be possible for a central axis of the second nozzle to be arranged so as to be offset to a vertical plane extending through the central axis of the first nozzle, such that the central axes intersect in a side view, but are arranged so as to be laterally offset relative to one another in an end view of the nozzles. Preferably, the central axis of the second nozzle is arranged between the plane extending through the central axis of the first nozzle and a plane that is tangential to the inner wall of the first nozzle. Such an asymmetrical arrangement of the two nozzles relative to one another can result in a turbulent flow at the outlet opening of the second nozzle, wherein, depending on the orientation of the nozzles relative to one another, metering of the material dispensing form the second nozzle can be influenced.

In an advantageous development, it may be possible for the central axis of the second nozzle to be arranged so as to be askew with respect to the central axis of the first nozzle. In the case of this spatially askew orientation of the central axes relative to one another, neither is a common point of intersection formed between the central axes, and nor are the central axes oriented so as to be mutually parallel. This askew arrangement can further increase the turbulence of the airflow at the outlet opening of the second nozzle, as a result of which, in addition to the possibility of metering, very fine atomization of the medium to be applied is also made possible.

According to a further preferred embodiment of the dispensing device, an inside diameter of the second nozzle is smaller than an inside diameter of the first nozzle. In this case, the inside diameter of the second nozzle has a direct influence on the dispensing of the medium to be applied, wherein a larger inside diameter of the second nozzle should be provided for a sprayable fluid of a higher viscosity or a powder having a coarser degree of grinding than in the case of a low-viscosity or runny fluid or a fine powder.

According to an advantageous development of the dispensing device, an outside diameter of the second nozzle is smaller than an outside diameter of the first nozzle. Providing such relative proportions of the first and second nozzle makes it possible for flow conditions to be formed at the outlet opening of the second nozzle in which the airflow undergoes acceleration, as a result of which, in addition to an increased dispensing of the medium to be dispensed from the storage container of the dispensing device, fine atomization of the fluid or powder is also achieved.

Particularly preferably, in a plan view of the outlet opening of the first nozzle, at least 30%, preferably a region of between 30% and 90%, of the internal cross section of the outlet opening of the first nozzle is covered. In the region of this degree of coverage of the outlet opening of the first nozzle, an optimal ratio between the fluid or powder dispensing amount and the degree of atomization of the fluid or powder can be achieved.

In a further embodiment of the dispensing device, it may be possible for the fluid line to the spray head to comprise a tapering, which is associated with the outlet opening of the second nozzle, and for the tapering to preferably be of a length of less than 1 cm. This tapering of the fluid line makes it possible for the inside diameter of the second nozzle to be adjusted to the material properties, for example the viscosity of the fluid to be dispensed or the degree of grinding of the powder. Furthermore, when the dispensing device is arranged in a usage position providing a tapering of this kind, in particular having a length of less than 1 cm, makes it possible to prevent the fluid or powder from dripping or trickling out of the storage container. An increased cross section of the fluid line in the storage container as far as the tapering is advantageous in that the Bernoulli effect makes it possible to still dispensing a sufficient amount of the fluid or powder.

It is preferably possible for the trailing edge of the second nozzle to be sharp-edged. Good atomization can be achieved thereby.

According to a further advantageous embodiment of the invention, the spray head is formed integrally with the first and second nozzle. In particular, the spray head is formed as an injection molded part. This allows for a cost-effective embodiment to be provided.

Preferably, a connection for the fluid line and/or the pressure line is formed on the spray head that is designed as an injection molded part.

It is preferably also possible for a closure cap for a cartridge, a vial or the like to be provided, in which the fluid to be dispensed is stored.

Figure 2:
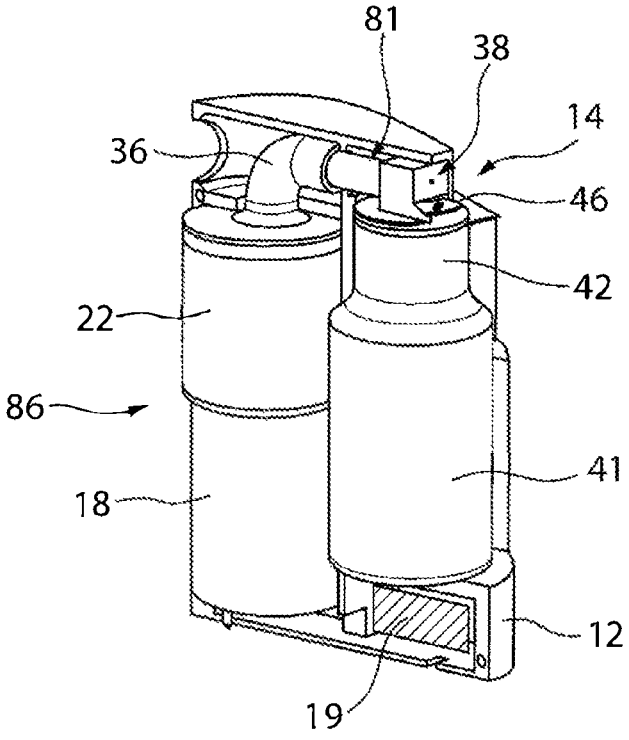
Figure 3:
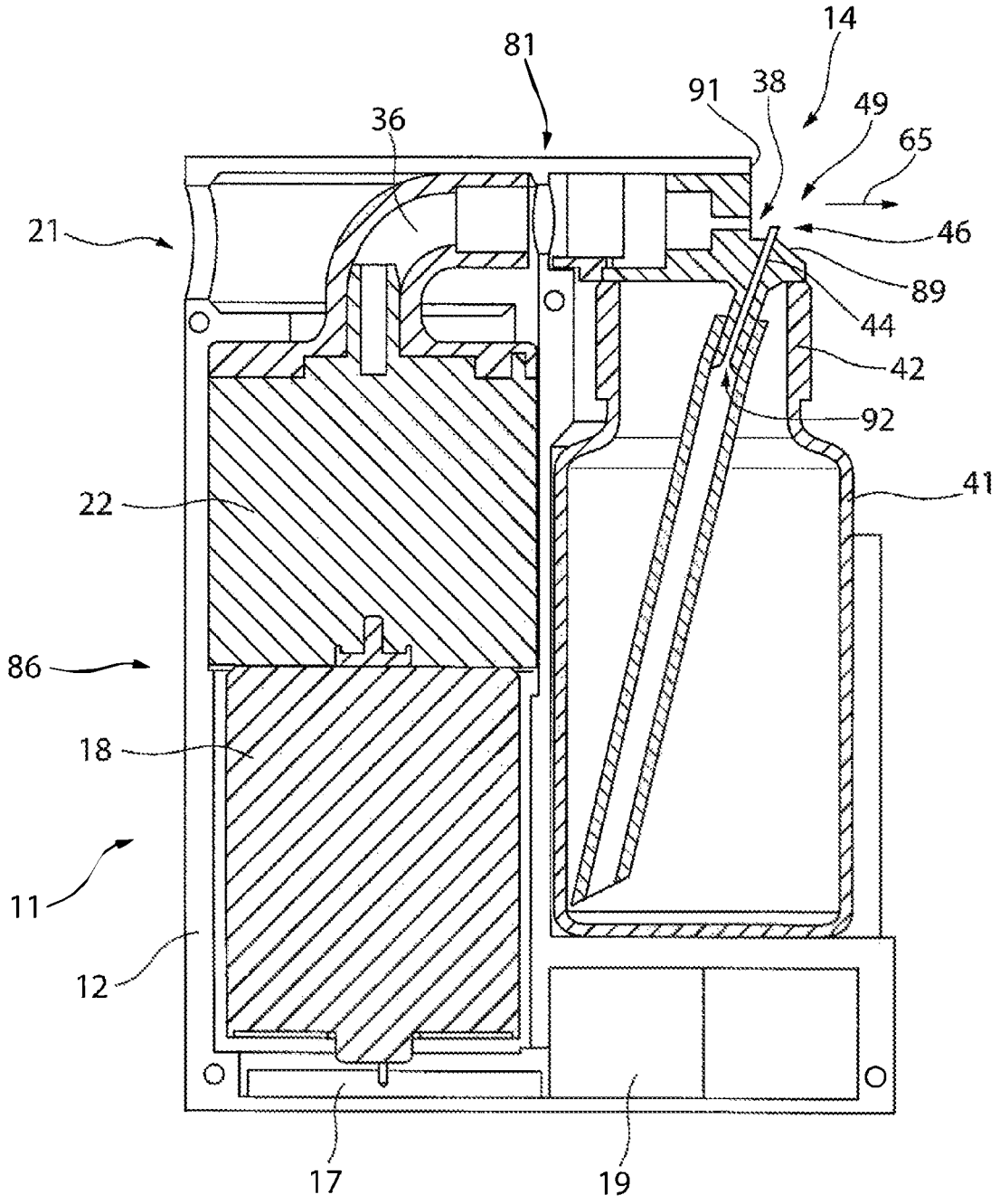
Figure 4:
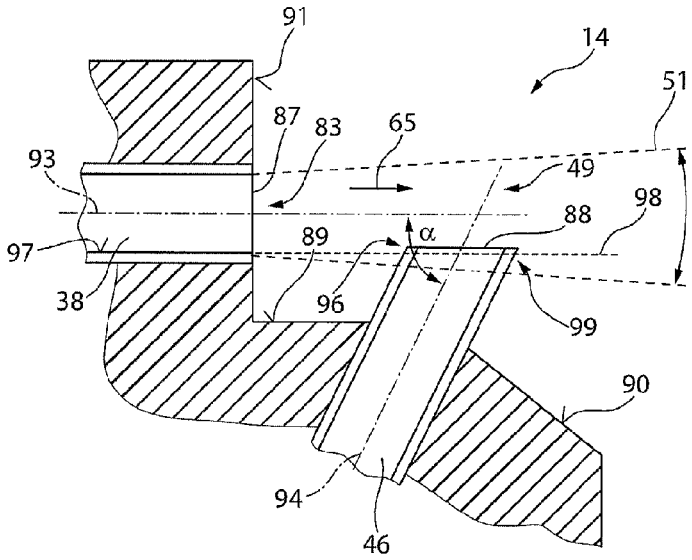
Figure 5:
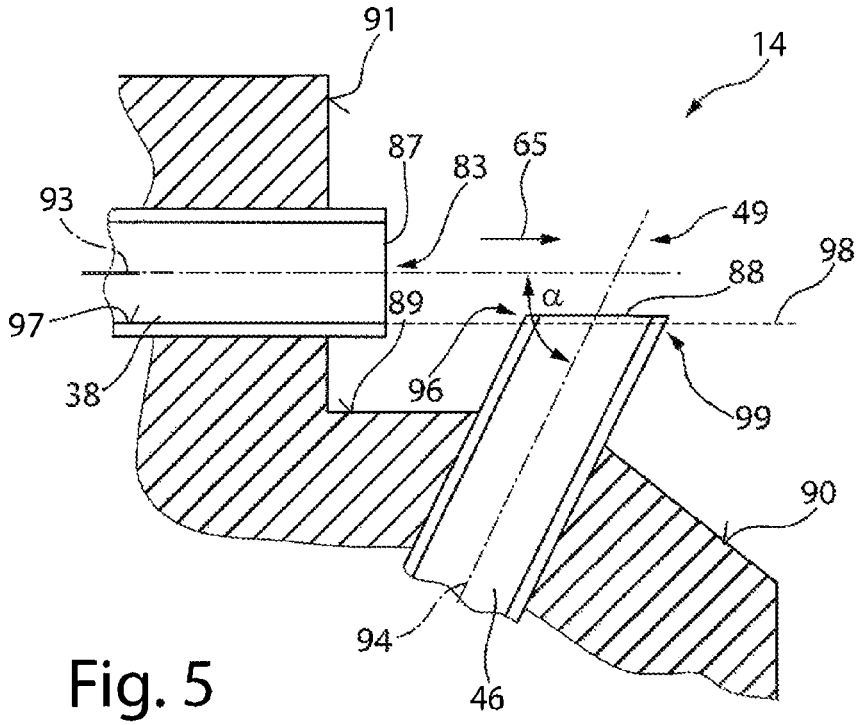
Figure 6:
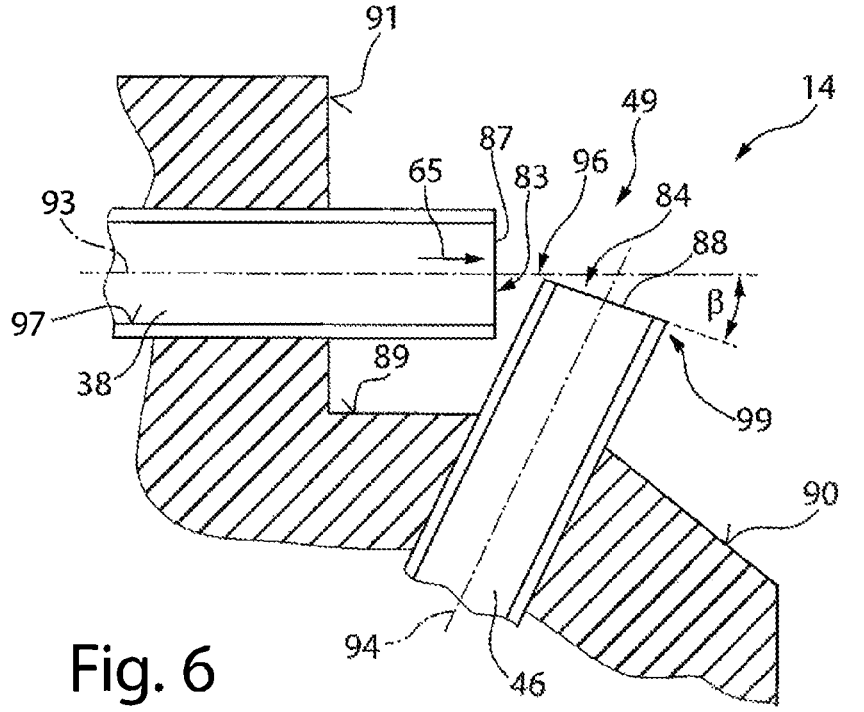
Figure 7:
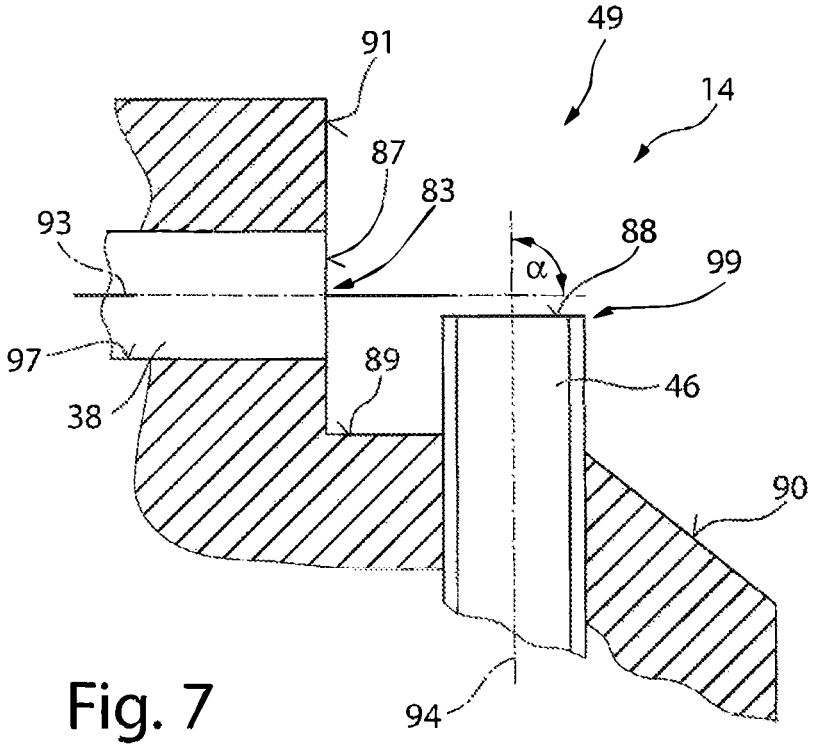
Figure 8:
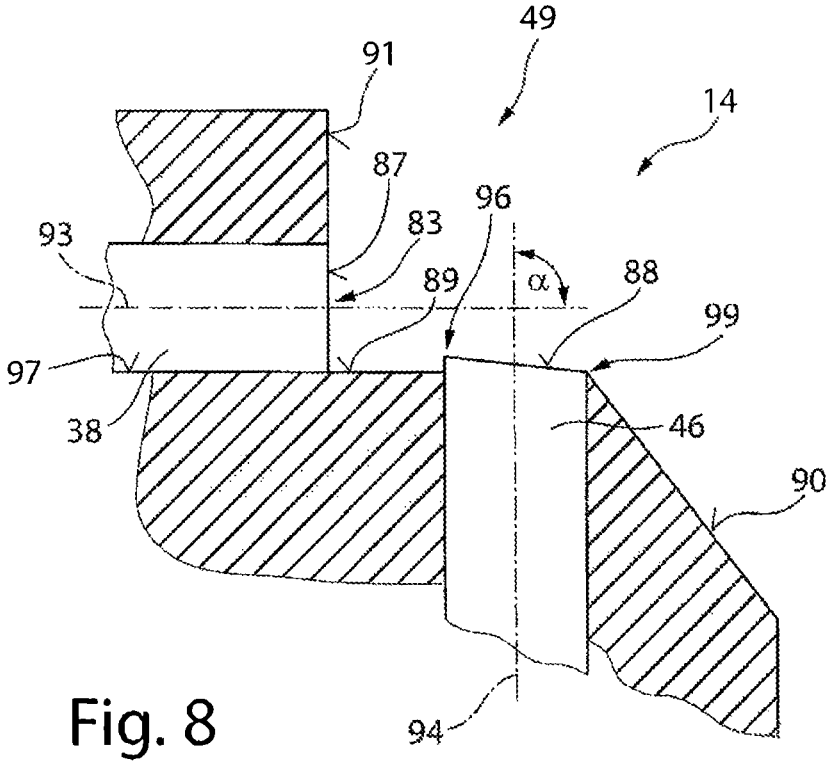
Figure 9:
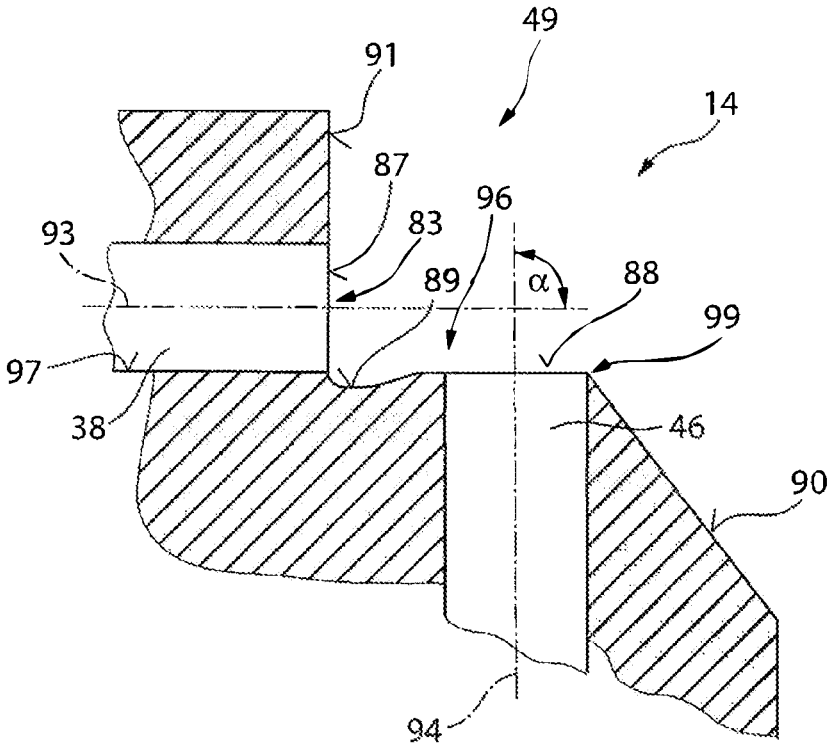
Figure 10:
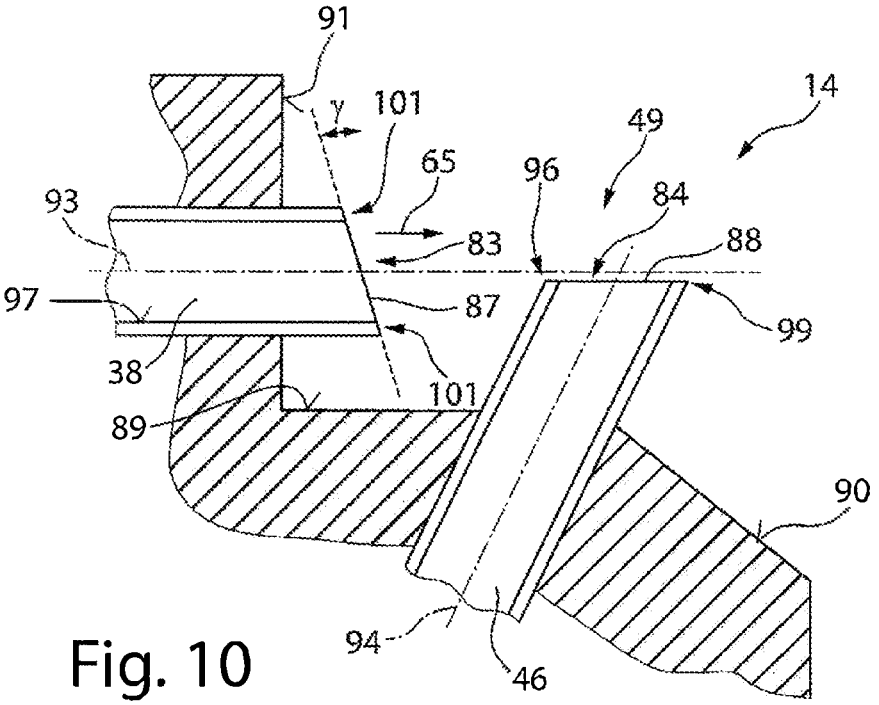
Figure 11:
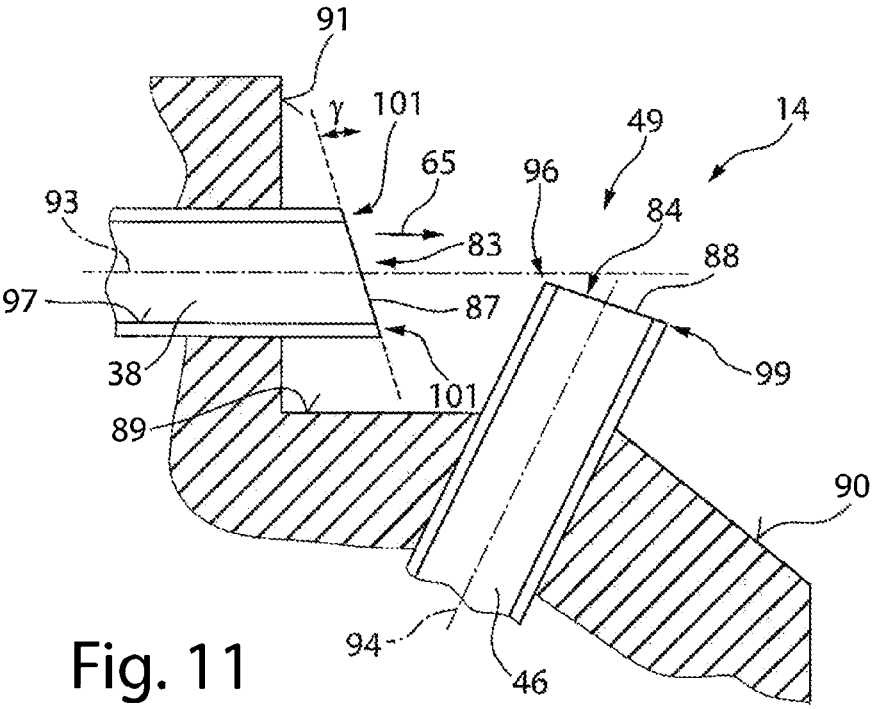
Figure 12:
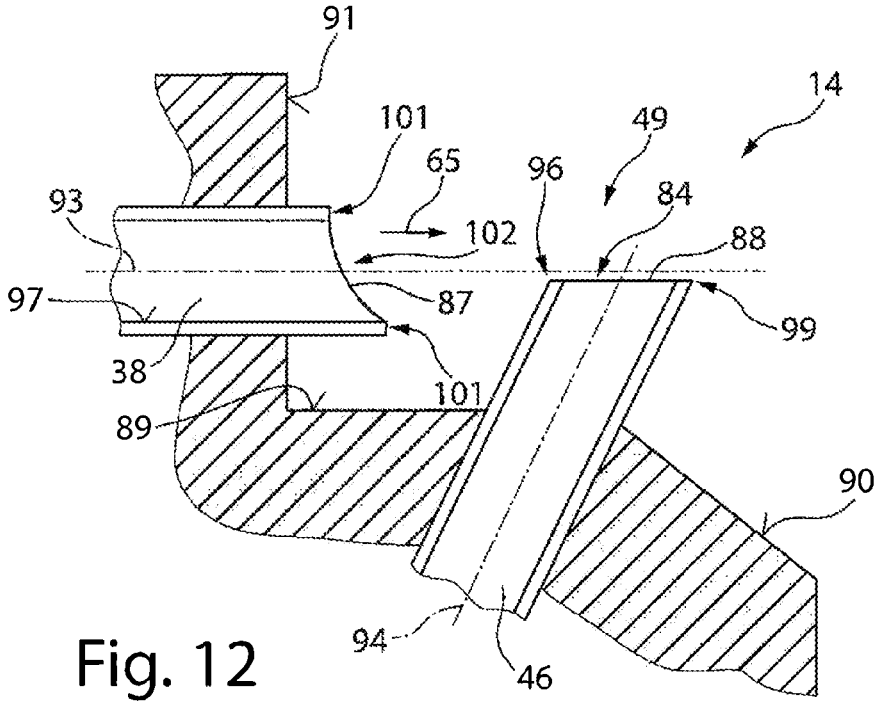
Figure 13:
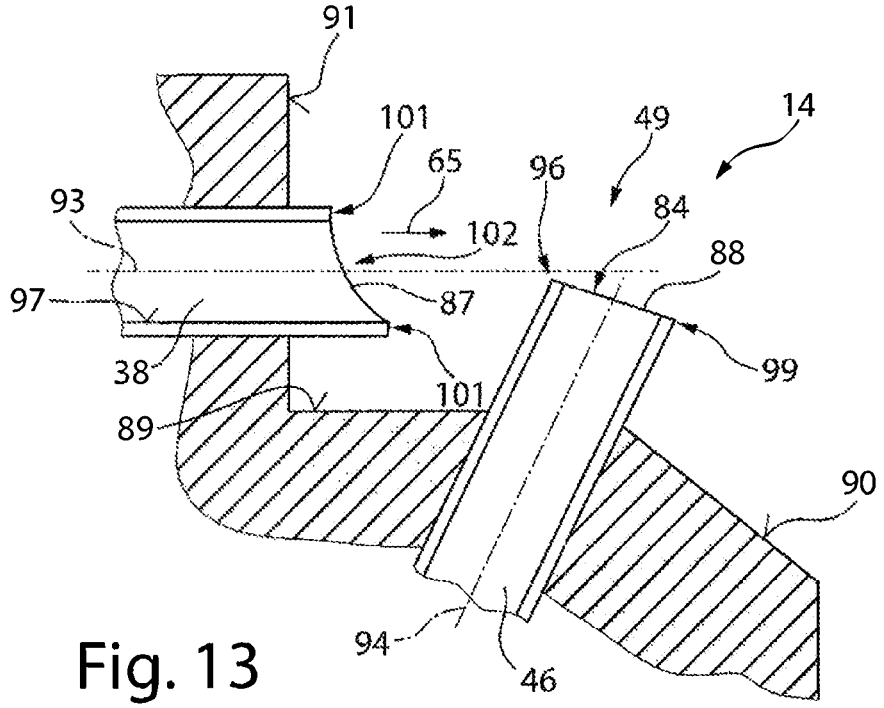
Figure 14:
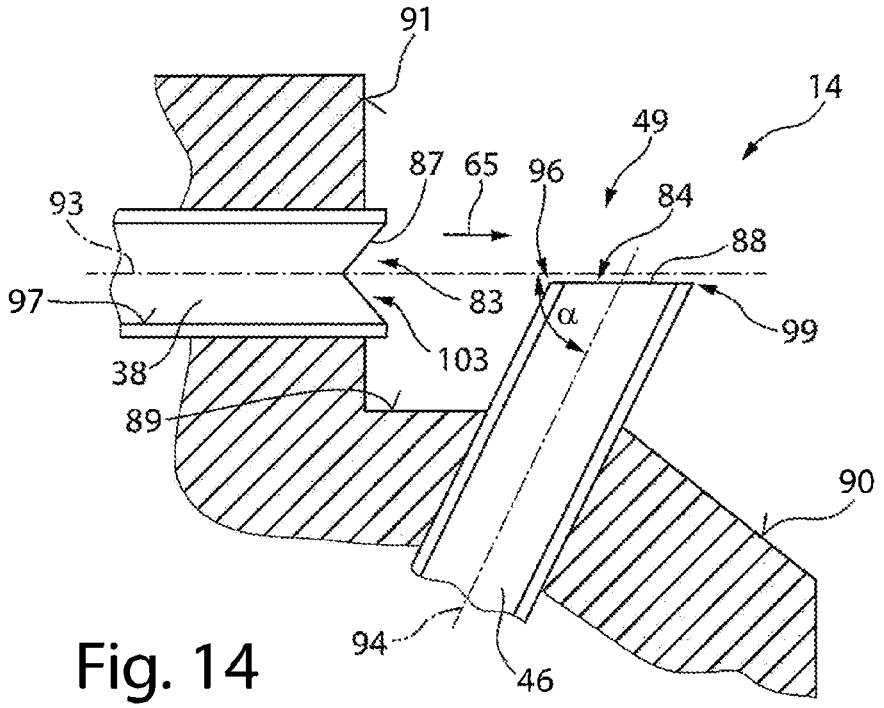
Figure 15:
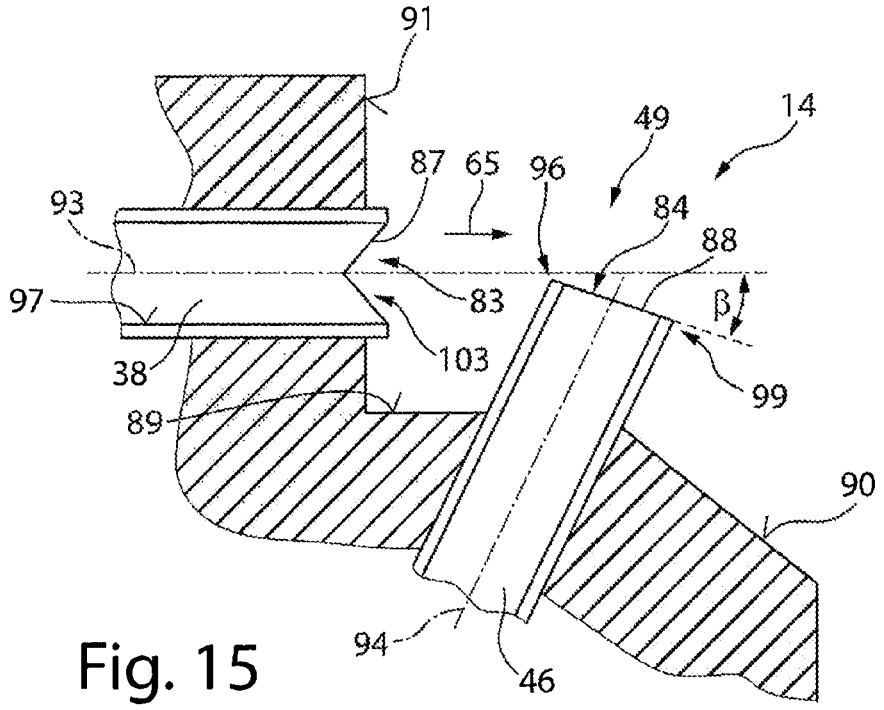
Figure 16:
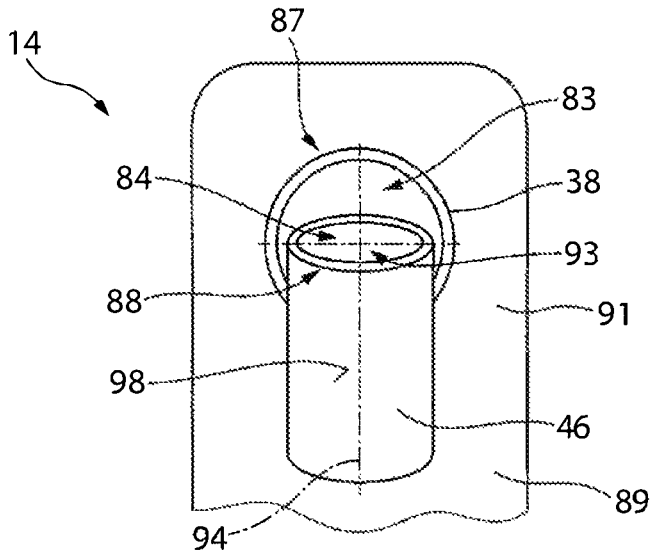
Figure 17:
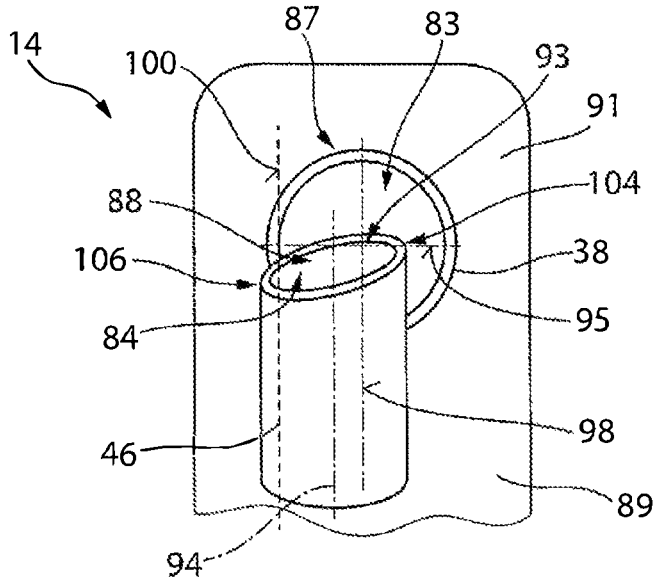

The invention and further advantageous embodiments and developments thereof are described and explained in greater detail in the following, with reference to the examples shown in the drawings. The features found in the description and in the drawings can be applied, according to the invention, individually or together, in any desired combination. In the figures:

FIG. 1: is a perspective view of a dispensing device,

FIG. 2: is a schematic detail of the dispensing device according to FIG. 1, FIG. 3: is a schematic cross section of the dispensing device according to FIG. 1, FIG. 4: is a schematic detail of two nozzles on a spray head of the dispensing device according to FIG. 1, FIG. 5: is a schematic detail of an alternative embodiment of the spray head according to FIG. 4, FIG. 6: is a schematic detail of an alternative arrangement of the nozzles on the spray head of the dispensing device according to FIG. 4, FIG. 7: is a schematic detail of an alternative embodiment to that of FIG. 4, FIG. 8: is a further schematic detail of an alternative embodiment of the spray head to that of FIG. 4, FIG. 9: is a schematic detail of a further alternative embodiment of the spray head to that of FIG. 4, FIG. 10: is a further schematic detail of an alternative arrangement of the nozzles on the spray head of the dispensing device according to FIG. 4, FIG. 11: is a further schematic detail of an alternative arrangement of the nozzles on the spray head of the dispensing device according to FIG. 4, FIG. 12: is a further schematic detail of an alternative arrangement of the nozzles on the spray head of the dispensing device according to FIG. 4, FIG. 13: is a further schematic detail of an alternative arrangement of the nozzles on the spray head of the dispensing device according to FIG. 4, FIG. 14: is a further schematic detail of an alternative arrangement of the nozzles on the spray head of the dispensing device according to FIG. 4, FIG. 15: is a further schematic detail of an alternative arrangement of the nozzles on the spray head of the dispensing device according to FIG. 4, FIG. 16 is a plan view of the outlet opening of the first nozzle of the spray head, showing a detail of the spray head, and FIG. 17 is a detail according to FIG. 8 of an alternative embodiment of the spray head.

FIG. 1 is a perspective view of a dispensing device 11 for spraying a sprayable fluid or powder. In addition, FIG. 2 shows the dispensing device 11 according to FIG. 1 comprising a housing 12, which is shown only in part, and FIG. 3 is a schematic cross section of the dispensing device 11 according to FIG. 1. The following embodiments are quasi based on FIGS. 1 to 3.

The dispensing device 11 is in particular designed as a handheld apparatus for dispensing a fluid or powdery medium, for example make-up, hairspray or the like. Said dispensing device 11 comprises a housing 12 and a spray head 14 that is arranged on the housing 12. As a result, at least one storage container 41 that can be inserted into the housing 12 can be replaced in a simplified manner. It may alternatively also be possible for a housing portion of the housing 12 to be removable, allowing only for access for inserting the storage container 41 and/or a fastener 42 and/or a spray head 14, such that all further components remain closed by the housing 12.

Preferably, a storage container 41 comprising a spray head 14 arranged thereon and a connector 81 is inserted as a unit into the housing 12. The housing 12 can comprise a receptacle into which the storage container 41 can be inserted by means of being clipped in. The storage container 41 can be received therein in a secure manner. The storage container 41 together with the spray head 14 can be removed from the housing 12 by means of at least one detachment element or one detachment button. Changing the storage container 41 together with the spray head 14 means that it is also not necessary to clean the spray head 14 when the medium to be applied is changed.

A compressed air device 86 is provided in the housing 12, by means of which device an airflow is generated and supplied to the spray head 14 by means of a supply line 36. Said compressed air device 86 operates using ambient air. An additional propellant gas, in the case of conventional spray cans, is not required. In particular, this supplies a first nozzle 38 on the spray head 14 with the airflow. The compressed air device 86 can for example comprise an electrical drive motor 18. Said motor is supplied for example by means of an accumulator 19 provided in the housing 12. Said accumulator can be provided in the housing 12 so as to be replaceable. Alternatively, wireless or wired charging of the accumulator 19 may be provided. The drive motor 18 can be contacted by means of a controller (not shown in greater detail). The drive motor 18 can be activated by means of a control knob on the housing 12, as a result of which an air pump 22 is driven, generating the airflow. The air pump 22 is supplied with air for example via inlet openings in the housing wall of the housing 12. In this case, one or more air inlet openings can preferably be provided with a filter in the housing wall. The airflow is supplied to the first nozzle 38 on the spray head 14 via the supply line 36. A connection 81 is provided between the supply line 36 and the spray head 14. Said connection 81 is preferably designed as a plug-in connection. Plugging or placing a connector on the spray head 14 in or on the connection 81 can establish a media-tight connection between the spray head 14 and the supply line 36. Said connection may be detachable, such that the spray head 14 can be designed so as to be replaceable. Instead of the supply line 36, a connection piece can also be provided, which piece can be arranged such that it can be pushed onto the spray head 14 and/or onto the air pump 22. An air pressure regulation means can be attached to the connection piece. Said means can be designed for example as a regulation opening, as a slide, as an adjusting wheel, or the like. In particular, a regulation means of this kind can be provided in the case of the integral spray head 14 in the form of an injection molded part.

According to FIG. 3, the storage container 41 and the closure 42 are preferably designed so as to be integral with the spray head 14. The spray head 14 can also be detachably fastened to the closure 42 and/or the storage container 41. In this case, the closure 42 can be connected to the spray head 14 by means of a flange, latching, clipped, plug-in or screw connection. The spray head 14 and the storage container 41 are preferably integral, so as to form a sales unit which can be inserted, as a whole, into the housing 12. The storage container 41 and/or the spray head 14 can comprise a supply air opening, such that pressure compensation in the storage container 41 is guaranteed automatically during dispensing of the medium. A viewing window 79 may be provided on the housing 12 and/or the storage container 41, in order for it to be possible to read off a filling level of the storage container 41 in a simple manner.

The spray head 14 comprises the first nozzle 38 which has an outlet direction for the airflow, according to the arrow 65 in FIG. 3. A second nozzle 46 is arranged at an angle of preferably less than 90°, in particular 89° to 80°. The fluid or powder stored in the storage container 41 is dispensed via said second nozzle 46. This arrangement and orientation of the two nozzles 38, 46 relative to one another forms an atomizing zone 49 outside of the spray head 14.

In order to dispensing the fluid or powder from the storage container 41, the airflow dispensed from the first nozzle 38 flows around the second nozzle 46. In particular, the airflow flows around the second nozzle 46 in the region of an outlet opening 84 of the nozzle 46, such that a generated Bernoulli effect generates a negative pressure at the outlet opening 84 of the nozzle 46. As a result of said negative pressure, the fluid or powder is conveyed out of the storage container 41 and supplied to the atomizing zone 49 via the second nozzle 46.

The outlet opening 84 of the second nozzle 46 protrudes into the airflow emerging from the first nozzle 38. As a result, the airflow can flow around the nozzle 46 in the dispensing direction 65. The first nozzle 38 can protrude relative to a first end face 91 of the spray head 14, as is shown in FIG. 5. Likewise, the first nozzle 38 can be provided so as to be flush to the end face 91 of the spray head 14, as is shown in FIG. 4. The outlet opening 84 of the second nozzle 46 protrudes on the spray head 14, relative to an end face 89 that defines the atomizing zone 49. Said end face 89 can be provided so as to slope away, proceeding from the second nozzle 46, such that the spray head 14 opens opposite the atomizing zone 49.

The fluid line 44 can comprise a tapering 92 proceeding from an end of the fluid line 44 located in the storage container 42 to the outlet opening 84 of the second nozzle 46. As a result, the nozzle cross section is smaller than the cross section of the fluid line 44 in the storage container 42 as far as the spray head 14. The tapering 92 can be of a length of less than 1 cm. This achieves an optimum dispensing of the medium from the storage container 41. This embodiment is furthermore advantageous in that, when the dispensing device 11 is switched off, the fluid or powder is withdrawn from the fluid line 44, in particular the nozzle 46, and returns into the upright storage container 41. As a result, drying out and clogging of the nozzle 46 can be prevented.

A protective cap can be provided on the spray head 14. Said protective cap can be connected to the spray head 14 by means of a film hinge. It may also be possible for the protective cap to be placed or pushed onto the spray head 14. The protective cap can comprise one or more closure elements, wherein a closure element is provided for the nozzle 46 dispensing the fluid, and preferably simultaneously a closure element for a ventilation opening leading to the storage container 41. As a result, the medium can be prevented from flowing out of or drying in the storage container 41. Furthermore, a protective cap of this kind is used to protect against damage.

FIGS. 4 to 17 show various schematically enlarged embodiments of the spray head 14, from which different positions, orientations and/or embodiments of the first nozzle 38 relative to the second nozzle 46 are evident. In this case, the outlet opening 84 of the second nozzle 46 protrudes into the airflow emerging from the first nozzle 38, in order to atomize the fluid or powder, dispensed via the second nozzle 46, in the atomizing zone 49. A nozzle arrangement of this kind makes it possible to achieve finer atomization than in the case of previous spray nozzles, such that the properties of the fluids can be changed positively.

According to FIGS. 4 to 15, the second nozzle 46 is arranged at an angle of incidence $\alpha$ of less than 90° to the central axis 93 of the first nozzle 38, in the dispensing direction 65. In particular, an angle of incidence $\alpha$ of 89° to 80° is formed between the central axis 93 of the first nozzle 38 and a central axis 94 of the second nozzle 46.

FIGS. 4 to 15 differ at least in that the embodiments and orientations of the front faces 87, 88 of the first and second nozzle 38, 46 differ from one another, wherein the different embodiments and orientations described in the following can be combined with one another as desired.

In the embodiment of the spray head 14 according to FIG. 4, a front face 87 of the first nozzle 38 is oriented so as to be orthogonal to the central axis 93 of the first nozzle 38, and a front face 88 of the second nozzle 46 is oriented so as to be in parallel with the central axis 93 of the first nozzle 38. A spray jet 51 is shown by way of example. The front face 87 of the first nozzle 38 is preferably located in an end face 91 of the spray head 14. The front face 88 of the second nozzle 46 preferably protrudes relative to an end face 89 of the spray head 14. The first end face 91 and the second end face 89 adjoin one another or transition into one another. The second end face 89 extends from the first end face 91 as far as the second nozzle 46. These are preferably arranged at an angle of 90°. A third end face 90 adjoins the second end face 89. Said faces can be located in the plane of the second end face 89 or can be inclined relative thereto, such that the open and outside atomizing zone 49 is formed. Said end faces 91, 89, 90 form a boundary between the housing 12 and the atomizing zone 49. Arranging the front face 87 of the first nozzle 38 in the end face 91 forms what is known as a wall nozzle. The second nozzle 46 protrudes relative to the second end face 89. The second end face 89 can be formed by a sloping surface that is oriented so as to be at an angle of more than 90° relative to the first end face 91 and transitions into the third end face 90. The second nozzle 46 comprises a leading edge 96 which is associated with the outlet opening 83 of the first nozzle 38. In this case, the second nozzle 46 is arranged in front of the outlet opening 83 of the first nozzle 38 in the outflow direction 65, such that, in a plan view of the outlet opening 83 of the first nozzle 38, at least 1% of a cross section of the outlet opening 83 of the first nozzle 38 is covered. Preferably, coverage of at least 30% can be provided. In particular, the front face 88 of the second nozzle 46 can be located between the axis 98 and the central axis 93, or above the central axis 93. This results in partial coverage of the airflow dispensed by the first nozzle 38, such that the airflow flows completely around the second nozzle 46, in particular an end portion of the second nozzle 46. It is in particular possible for a region of between 30% and 90% of the internal cross section of the outlet opening 83 of the first nozzle 38 to be covered, in a plan view of the outlet opening 83 of the first nozzle 38.

It may be possible for the leading edge 96 of the second nozzle 46 to be directly associated with the outlet opening 83 of the first nozzle 38, for example for the leading edge 96 to contact the front face 87 of the first nozzle 38 in a tangential manner. (This is shown by way of example in FIG. 6). The airflow emerging from the first nozzle 38 strikes the leading edge 96, such that a flow around the outlet opening 84 of the second nozzle 46 is formed, and the negative pressure is generated at the outlet opening 84 of the second nozzle 46 as a result of the Bernoulli effect.

The trailing edge 99 is preferably sharp-edged. This is in particular provided in all the embodiments.

FIG. 5 shows an alternative arrangement of the first and second nozzle 38, 46 in the atomizing zone 39. The embodiment according to FIG. 5 differs from the embodiment according to FIG. 4 in that the front face 87 of the first nozzle 38 protrudes on the spray head 14, relative to the first end face 91. Otherwise, the embodiment corresponds to the embodiment according to FIG. 4.

FIG. 6 differs from FIG. 4 or FIG. 5 in that the front face 88 of the second nozzle 46 is oriented so as to be inclined relative to the central axis 93 of the first nozzle 38. As a result of the inclination of the front face 88, the orientation of the outlet opening 84 of the second nozzle 46 faces in an opposing direction with respect to the outlet opening 83 of the first nozzle 38. For this purpose, the leading edge 96 is associated with the first nozzle 38, and a trailing edge 99 opposite the leading edge 96 is arranged towards a side remote from the first nozzle 38, in the dispensing direction 65. In this case, an angle of inclination $\beta$ of more than 0° is formed between the front face 88 of the second nozzle 46 and the central axis 93 of the first nozzle 38. In particular, an angle of inclination of more than 1° is formed between the central axis 93 and the front face 88.

FIG. 7 shows a further alternative embodiment of the spray head 14 to that of FIG. 4. According to this embodiment, the first nozzle 38 is formed as a hole in the spray head 14. In FIG. 4, the nozzle 38 is formed as an inserted tube portion. In the embodiment according to FIG. 7, this can make it possible to simplify the manufacture. For example, the second nozzle 46 is inserted into the spray head 14 as a tube portion. With respect to a longitudinal axis 94, said tube portion in the nozzle 46 can be oriented so as to be at an angle of 90° the longitudinal axis 93 of the first nozzle 38. The second nozzle 46 can also be inclined, as is shown for example in FIGS. 5 and 6. It is also possible for the second end face 89 to be oriented so as to be inclined relative to the first end face 91. The second end face and the third end face 89, 90 can also be located in a plane.

FIG. 8 shows a further alternative embodiment to that of FIG. 7. According to this embodiment, the first nozzle 38 is formed as a hole in the spray head 14. Furthermore, the second nozzle 46 is also formed as a hole in the spray head 14. With respect to the longitudinal axis 94, said second nozzle 46 can be oriented so as to be at right-angles to the longitudinal axis 93 of the first nozzle 38. The longitudinal axis 94 of the second nozzle 46 can also be oriented so as to be at an angle of less than 90° to the longitudinal axis 93 of the first nozzle 38.

It is preferably possible for a leading edge 96, which protrudes relative to the second end face 89, to be formed between the second end face 89 and the nozzle opening 84 of the second nozzle 46. The front face 88 of the second nozzle 46 can be oriented so as to be in parallel with the longitudinal axis 93 of the first nozzle 38, or can be inclined relative thereto, towards the third end face 90. In particular, the trailing edge 99 can be formed on the dispensing side in a transition region between the second nozzle 46 and the third end face 90.

It is preferably possible for an inner wall 97 of the hole of the first nozzle 38 to be formed so as to be flush to the second end face 89.

FIG. 9 is a schematic detail of a further alternative embodiment of the spray head 14. In this embodiment, the first and second nozzle 38, 46 are in each case provided as a hole in the spray head 14. The spray head 14 preferably consists of a plastics part, in particular an injection molded plastics part. The longitudinal axis 94 of the second nozzle 46 is preferably oriented so as to be at right-angles to the longitudinal axis 93 of the first nozzle 38. The first nozzle 38 is formed as a wall opening, i.e. the front face 87 of the first nozzle 38 is located in the end face 91. The second end face 89 is formed between the end face 87 of the first nozzle 38 and a leading edge 96 of the second nozzle 46, wherein said second end face has a trough-like course or a depression. A preferably continuous transition is provided from a lowest point of the depression as far as the leading edge 96. As a result, an additional nozzle effect or entrainment effect can be achieved. Furthermore, the outflowing medium, in particular air, from the nozzle 38 can result in a fluid or powdery medium, which is supplied to the second nozzle 46, not collecting in the corner region or in the depression of the second end face 89. In order to form the trailing edge 99, the third end face 90 is arranged so as to be inclined relative to the front face 88 of the second nozzle 46. A sharp-edged trailing edge 99 can be achieved thereby.

FIGS. 10 and 11 each show an alternative embodiment of the dispensing device 11 in which, compared with the embodiment according to FIG. 5, the front face 87 of the first nozzle 38 is oriented so as to be inclined relative to the central axis 93 of the first nozzle 38. In this case, the angle of inclination $\gamma$ is less than 90° to the central axis 93 of the first nozzle 38; in particular the angle of inclination is in a range of between 1° and 20°. Said inclined front face 87 forms two stall edges 101 on the first nozzle 38. One of the two stall edges 101 is set back relative to the central axis 93, in the dispensing direction 65, and the other stall edge 101 protrudes relative to the central axis 93. In this case, the protruding stall edge 101 is associated with the second nozzle 46.

FIGS. 12 and 13 each show a further alternative embodiment of the dispensing device 11 in which, compared with the embodiment according to FIG. 5, the front face 87 of the first nozzle 38 comprises a cannula-like bevel 102. In a vertical longitudinal section through the nozzle 38, said cannula-like bevel provides a concave design of the front face 87. Two stall edges 101 are also formed on the first nozzle 38, by the cannula-like bevel 102, wherein one of the two stall edges 101 is set back relative to the central axis 93, in the dispensing direction 65, and the other stall edge 101 protrudes relative to the central axis 93. In this case, the protruding stall edge 101 is associated with the second nozzle 46.

FIGS. 14 and 15 show an alternative embodiment of the front face 87 of the nozzle 38 of the dispensing device 11 to that of Fig. and FIG. 6. In this embodiment, the front face 87 of the first nozzle 38 comprises a V-shaped bevel 103. Likewise, the bevel 103 of the front face 87 can be U-shaped. In this embodiment, two stall edges 101 are formed which are arranged in a common plane orthogonally to the central axis 93 of the first nozzle 38.

FIG. 16 is a plan view of the outlet opening 83 of the first nozzle 38, showing a detail of the spray head 14. This view makes it clear that the two nozzles 38, 46 can be oriented relative to one another such that the central axis 94 of the second nozzle 46 is arranged in a plane that extends through the central axis 93 of the first nozzle 38. In this arrangement, the second nozzle 46 is oriented centrally with respect to the first nozzle 38, such that the two central axes 93, 94 form a common point of intersection.

In this case, an outside diameter of the second nozzle 46 can be smaller than an outside diameter of the first nozzle 38. These ratios of the diameters to one another can influence the flow conditions of the airflow at the outlet opening 84 of the second nozzle 46. As a result, an optimal flow around the outlet opening 84 of the second nozzle 46 can be achieved.

The inside diameter of the two nozzles 38, 46 is designed in accordance with the viscosity of the fluid to be sprayed or the degree of grinding of the powder. In the case of a fluid having a high viscosity, or a powder having a coarse degree of grinding, the inside diameter is larger than in the case of a fluid having a low viscosity or a powder having a fine degree of grinding. In this case, the inside diameter of the first nozzle 38 that dispenses the airflow can have a larger inside diameter than the second nozzle 46 that dispenses the fluid or powder. As a result, very fine to fine atomization of the fluid or powder can be achieved. The difference of the inside diameters between the first nozzle 38 and the second nozzle 46 can advantageously be 0.1 mm to 0.2 mm. Accordingly, as the viscosity of the fluid increases or as the degree of grinding of the powder increases, the inside diameter of the first nozzle 38 and the inside diameter of the second nozzle 46 can be for example 0.3 mm to 0.2 mm, 0.4 mm to 0.2 mm, 0.4 mm to 0.3 mm or 0.5 mm to 0.3 mm or 0.5 mm to 0.4 mm or 0.6 mm to 0.4 mm or 0.6 mm to 0.5 mm or 0.7 mm to 0.5 mm or 0.7 mm to 0.6 mm or 0.8 mm to 0.7 mm or 0.8 mm to 0.6 mm, etc. (the first value corresponds to the inside diameter of the first nozzle 38, the second value corresponds to the inside diameter of the second nozzle 46).

FIG. 17 shows an alternative arrangement of the nozzles 38, 46 with respect to one another, in which the central axis 94 of the second nozzle 46 is arranged so as to be laterally offset relative to a plane that extends through the central axis 93 of the first nozzle 38. In particular, in this case, the central axis 94 of the second nozzle 46 is arranged between the plane extending through the central axis 93 of the first nozzle 38 and the plane 98 that is tangential to the inner wall 97 of the first nozzle 38. In the case of such an offset arrangement of the two nozzles 38, 46 relative to one another, it is likewise possible for the two central axes 93, 94 of the nozzles 38, 46 to be oriented so as to be askew with respect to one another. In the case of such an askew orientation of the two central axes 93, 94 relative to one another, said axes neither form a common point of intersection, and nor are the central axes 93, 94 oriented so as to be mutually parallel.

According to FIG. 17, in a plan view of the outlet opening 83 of the first nozzle 38, the front face 88 of the second nozzle 46 is arranged obliquely, such that a side edge 104 of the front face 88 is set back relative to the central axis 94, in the fluid dispensing direction, and an opposing side edge 106 of the front face 88 protrudes relative to the central axis 94.

The invention claimed is:

1. A dispensing device for spraying a sprayable medium, in which the device is designed as a handheld apparatus, comprising a housing, in which a compressed air device is provided, a spray head that is connected to the housing and is intended for dispensing the medium, a receiving chamber that is arranged in the housing and is intended for a storage container in which the medium to be dispensed is stored, a fluid line that leads out of the storage container to the spray head, and a supply line that leads from the compressed air device to the spray head, wherein the spray head comprises a first nozzle that is connected to the supply line and, separately therefrom, a second nozzle that is connected to the fluid line, wherein the second nozzle is arranged at an angle of incidence ($\alpha$) of 90° or less than 90° to the central axis of the first nozzle, in the dispensing direction, and protrudes into an airflow emerging from the first nozzle, such that a spray jet including an atomizing zone is formed outside the spray head, wherein the first nozzle is formed as a hole in the spray head and the second nozzle is formed as a hole or as an inserted tube portion in the spray head, wherein a front face of the first nozzle is located in a first end face of the spray head and a front face of the second nozzle is located in a second end face of the spray head or protrudes on the spray head, relative to the second end face, wherein a leading edge and a trailing edge, opposite the leading edge, is provided on a front face of the second nozzle, wherein the leading edge of the second nozzle is associated with the first nozzle and the front face of the second nozzle is arranged at an angle of incident flow ($\beta$) of more than 0° relative to the central axis of the first nozzle, such that the outlet opening of the second nozzle is oriented so as to face away from the outlet opening of the first nozzle, wherein at least an inside diameter of the second nozzle is smaller than an inside diameter of the first nozzle or an outside diameter of the second nozzle is smaller than an outside diameter of the first nozzle, and wherein the front face of the first nozzle protrudes relative to the first end face and is oriented so as to be at an angle of inclination of less than 90° relative to the central axis of the first nozzle, and a stall edge that is set back and a stall edge that protrudes, relative to the central axis of the first nozzle, is formed in the dispensing direction, wherein the protruding stall edge of the leading edge is associated with the second nozzle.

2. The dispensing device according to claim 1, wherein, in a plan view of an outlet opening of the first nozzle, the second nozzle covers at least 1% of an internal cross section of the first nozzle, and in a plan view of the outlet opening of the first nozzle the second nozzle preferably covers at least 30% of the internal cross section of the outlet opening of the first nozzle.

3. The dispensing device according to claim 1, wherein the atomizing zone is formed outside an end face of the spray head that comprises the first nozzle, and outside a second end face of the spray head that comprises the second nozzle, and are preferably arranged so as to be at right-angles or at an angle of more than 90° relative to one another, or the second end face has a trough-like course as far as the second nozzle.

4. The dispensing device according to claim 1, wherein the leading edge of the second nozzle is tangentially associated with the outlet opening of the first nozzle.

5. The dispensing device according to claim 1, wherein, in a plan view of the outlet opening of the first nozzle, the front face of the second nozzle is inclined relative to a plane that extends horizontally through the central axis of the first nozzle.

6. The dispensing device according to claim 5, wherein a side edge of the second nozzle, seen in a plan view of the outlet opening of the first nozzle is arranged above the plane that extends horizontally through the central axis of the first nozzle, and a side edge opposite the side edge is arranged below said plane, or the side edges of the second nozzle, seen in a plan view of the outlet opening of the first nozzle, are arranged over the plane that extends horizontally through the central axis of the first nozzle.

7. The dispensing device according to claim 1, wherein the central axis of the second nozzle is arranged so as to be offset with respect to a vertical plane extending through the central axis of the first nozzle, and the central axis of the second nozzle is arranged between the vertical plane extending through the central axis of the first nozzle and a vertical plane that is tangential to the inner wall of the first nozzle.

8. The dispensing device according to claim 1, wherein the central axis of the second nozzle is arranged so as to be askew relative to the central axis of the first nozzle.

9. The dispensing device according to claim 1, wherein the trailing edge of the second nozzle is sharp-edged.

10. The dispensing device according to claim 1, wherein the spray head is a unitary part including the first nozzle and the second nozzle.

11. The dispensing device according to claim 1, wherein a connection for the fluid line and the compressed air line is formed on the spray head.

12. The dispensing device according to claim 10, wherein the spray head is an injection molded part.

13. A dispensing device for spraying a sprayable medium, in which the device is designed as a handheld apparatus, comprising a housing, in which a compressed air device is provided, a spray head that is connected to the housing and is intended for dispensing the medium, a receiving chamber that is arranged in the housing and is intended for a storage container in which the medium to be dispensed is stored, a fluid line that leads out of the storage container to the spray head, and a supply line that leads from the compressed air device to the spray head, wherein the spray head comprises a first nozzle that is connected to the supply line and, separately therefrom, a second nozzle that is connected to the fluid line, wherein the second nozzle is arranged at an angle of incidence ($\alpha$) of 90° or less than 90° to the central axis of the first nozzle, in the dispensing direction, and protrudes into an airflow emerging from the first nozzle, such that a spray jet including an atomizing zone is formed outside the spray head, wherein the first nozzle is formed as a hole in the spray head and the second nozzle is formed as a hole or as an inserted tube portion in the spray head, wherein a front face of the first nozzle is located in a first end face of the spray head and a front face of the second nozzle is located in a second end face of the spray head or protrudes on the spray head, relative to the second end face, wherein a leading edge and a trailing edge, opposite the leading edge, is provided on a front face of the second nozzle, wherein the leading edge of the second nozzle is associated with the first nozzle and the front face of the second nozzle is arranged at an angle of incident flow ($\beta$) of more than 0° relative to the central axis of the first nozzle, such that the outlet opening of the second nozzle is oriented so as to face away from the outlet opening of the first nozzle, wherein at least an inside diameter of the second nozzle is smaller than an inside diameter of the first nozzle or an outside diameter of the second nozzle is smaller than an outside diameter of the first nozzle, and wherein the front face of the first nozzle protrudes relative to the first end face and comprises a cannula-like bevel, and a stall edge that protrudes relative to the outlet opening is formed in the dispensing direction, which edge is associated with the second nozzle.

14. A dispensing device for spraying a sprayable medium, in which the device is designed as a handheld apparatus, comprising a housing, in which a compressed air device is provided, a spray head that is connected to the housing and is intended for dispensing the medium, a receiving chamber that is arranged in the housing and is intended for a storage container in which the medium to be dispensed is stored, a fluid line that leads out of the storage container to the spray head, and a supply line that leads from the compressed air device to the spray head, wherein the spray head comprises a first nozzle that is connected to the supply line and, separately therefrom, a second nozzle that is connected to the fluid line, wherein the second nozzle is arranged at an angle of incidence ($\alpha$) of 90° or less than 90° to the central axis of the first nozzle, in the dispensing direction, and protrudes into an airflow emerging from the first nozzle, such that a spray jet including an atomizing zone is formed outside the spray head, wherein the first nozzle is formed as a hole in the spray head and the second nozzle is formed as a hole or as an inserted tube portion in the spray head, wherein a front face of the first nozzle is located in a first end face of the spray head and a front face of the second nozzle is located in a second end face of the spray head or protrudes on the spray head, relative to the second end face, wherein a leading edge and a trailing edge, opposite the leading edge, is provided on a front face of the second nozzle, wherein the leading edge of the second nozzle is associated with the first nozzle and the front face of the second nozzle is arranged at an angle of incident flow ($\beta$) of more than 0° relative to the central axis of the first nozzle, such that the outlet opening of the second nozzle is oriented so as to face away from the outlet opening of the first nozzle, wherein at least an inside diameter of the second nozzle is smaller than an inside diameter of the first nozzle or an outside diameter of the second nozzle is smaller than an outside diameter of the first nozzle, wherein, in a plan view of the outlet opening of the first nozzle, the front face of the second nozzle is inclined relative to a plane that extends horizontally through the central axis of the first nozzle, and wherein a side edge of the second nozzle, seen in a plan view of the outlet opening of the first nozzle is arranged above the plane that extends horizontally through the central axis of the first nozzle, and a side edge opposite the side edge is arranged below said plane.

* * * * *